US011486100B2

(12) United States Patent
West

(10) Patent No.: US 11,486,100 B2
(45) Date of Patent: Nov. 1, 2022

(54) ACCESS MAT SYSTEM AND METHOD OF ASSEMBLY

(71) Applicant: Lone Pine Forest Products, AB (CA)

(72) Inventor: Gary West, Rocky Mountain House (CA)

(73) Assignee: Lone Pine Forest Products, Rocky Mountain (CA)

( * ) Notice: Subject to any disclaimer, the term of this patent is extended or adjusted under 35 U.S.C. 154(b) by 37 days.

(21) Appl. No.: 17/082,781

(22) Filed: Oct. 28, 2020

(65) Prior Publication Data

US 2022/0127796 A1 Apr. 28, 2022

(51) Int. Cl.
*E01C 9/08* (2006.01)

(52) U.S. Cl.
CPC ..... *E01C 9/086* (2013.01)

(58) Field of Classification Search
None
See application file for complete search history.

(56) References Cited

U.S. PATENT DOCUMENTS 20,693 A * 6/1858 Bennett ..... B25G 3/28 174/199
201,378 A * 3/1878 Allen ..... F16B 5/0052 411/460
569,235 A * 10/1896 Rockwell ..... B29C 66/1122 411/460
646,164 A * 3/1900 Cathrein ..... F16B 13/124 217/65
724,897 A * 4/1903 Lee ..... F16B 7/0413 403/296
1,229,538 A 6/1917 Riiping
2,714,831 A * 8/1955 De Anguera ..... F16B 15/06 411/454
3,172,170 A * 3/1965 Webster ..... B27M 3/0046 52/585.1
3,178,984 A 4/1965 Barothy
3,613,221 A * 10/1971 Pronk ..... F16B 13/00 52/235
4,289,420 A * 9/1981 Davis ..... E01C 9/086 404/35
4,407,342 A * 10/1983 Deaner ..... B27M 1/00 72/275

(Continued)

FOREIGN PATENT DOCUMENTS

DE 19506379 C2 9/2001

OTHER PUBLICATIONS

Dowel rods and dowel pins on Architecturals.net Wayback Machine capture of weblink: http://www.architecturals.net/dowel-rodsand-dowel-pins/3 (Year: 2010).*

*Primary Examiner* — Abigail A Risic
(74) *Attorney, Agent, or Firm* — Stratford Group Ltd.

(57) ABSTRACT

An access mat system and method of assembly is provided. An access mat system, comprising a plurality of wooden layers, the layers arranged in a stacked orientation. A plurality of blind holes bored in the plurality of wooden layers, the plurality of blind holes in one or more of the plurality of wooden layers positioned to correspond to the plurality of blind holes in one or more of the plurality of wooden layers and a plurality of biodegradable fasteners for insertion into the plurality of blind holes.

17 Claims, 8 Drawing Sheets

(56) References Cited

U.S. PATENT DOCUMENTS

| | | | | |
|---|---|---|---|---|
| 4,600,336 | A * | 7/1986 | Waller, Jr. | E01C 9/086 52/592.1 |
| 4,973,193 | A * | 11/1990 | Watson | E01C 9/086 404/46 |
| 5,316,408 | A * | 5/1994 | Stanley | E01C 9/086 238/14 |
| 5,658,086 | A * | 8/1997 | Brokaw | A47B 13/003 403/DIG. 7 |
| 5,822,944 | A * | 10/1998 | Penland, Sr. | E01C 9/086 52/592.1 |
| 6,474,905 | B1 * | 11/2002 | Smith, Jr | E01C 5/14 404/35 |
| 6,945,732 | B2 * | 9/2005 | Renick | E01C 9/086 404/35 |
| 7,856,933 | B2 | 12/2010 | Miller et al. | |
| 8,066,447 | B2 * | 11/2011 | Brandstrom | B27M 3/008 144/353 |
| 10,005,586 | B1 * | 6/2018 | Miller | B65D 19/0095 |
| 2004/0052606 | A1 | 3/2004 | Kerl | |
| 2007/0269262 | A1 | 11/2007 | Bertsche | |
| 2008/0028703 | A1 * | 2/2008 | Brandstrom | B27M 3/008 52/747.1 |
| 2012/0186186 | A1 * | 7/2012 | Michiels | E04B 1/483 52/698 |
| 2013/0051911 | A1 * | 2/2013 | Corser | E01C 9/086 404/35 |
| 2015/0043970 | A1 * | 2/2015 | Dressler | E01C 9/086 404/36 |
| 2017/0247883 | A1 * | 8/2017 | Iverson | E04C 3/16 |
| 2019/0085886 | A1 | 3/2019 | Davis et al. | |
| 2020/0241103 | A1 * | 7/2020 | Vernon | G01S 19/14 |

* cited by examiner

ACCESS MAT SYSTEM AND METHOD OF ASSEMBLY

FIELD OF THE INVENTION

The present disclosure relates to an access mat assembly, more specifically but not by way of limitation, an access mat system and method of assembly that is composed of environmentally friendly, recyclable and compostable materials.

BACKGROUND

Access mats are employed as temporary roadways on construction sites and are based on minimal disturbance and destruction to the environment, as well as the prevention of the transfer of weeds from site to site. Traditionally, access mats are built with carriage bolts recessed in the bottom of the access mat. The life expectancy of these types of access mats are on average only three years or less. In some unfortunate scenarios, these access mats breakdown during their first use. Once the access mats are rendered incapable of serving their function, disposal of the damaged access mats becomes a problem as waste disposal companies won't accept the damaged access mats due to the plurality of bolts within the access mats. One common solution for disposal of the access mats currently employed is to burn the access mats and collect the bolts afterwards. Although this is relatively quick and simple to execute, any toxic material burned is damaging to the environment and the wood, bolts and other materials used in the access mat are not recycled.

U.S. Pat. No. 7,856,933 B2 (Miller et al.) discloses a pallet comprising a plurality of stringers with bores, a plurality of deck boards with openings, and a plurality of wooden dowels disposed in the bores and openings to connect the stringers and deck boards. Shortcomings include a lack of environmentally friendly, recyclable and compostable materials, as well as a lack of durability.

U.S. Pub. No. 2007/0269262 A1 (Bertsche) discloses a connector for timer construction. Shortcomings include an inability to couple dowels between two or more connectors, a lack of durability and sufficient adhesion across all connected members and components.

U.S. Pat. No. 2,714,831 A (De Anguera), U.S. Pat. No. 3,178,984 A (Barothy), U.S. Pub. No. 2004/0052606 A1 (Kul), and U.S. Pub. No. 2019/0085886 A1 (Davis et al.) disclose threaded dowels of varying configurations. These threaded dowels lack sufficient adhesion capabilities.

U.S. Pat. No. 1,687,207 A (Hawker), U.S. Pat. No. 1,229,528 A (Ruping), and U.S. Pat. No. 646,164 A (Cathrein) disclose dowel pins of varying configurations. These dowel pins lack sufficient adhesion capabilities.

All documents cited herein are incorporated by reference.

There is a need for an access mat system and method of assembly that is composed of environmentally friendly, recyclable and compostable materials, is highly durable and is lightweight for undemanding transportation between worksites.

BRIEF SUMMARY

It is the object of the present invention to provide an access mat system. An access mat system, comprising a plurality of wooden layers, the layers arranged in a stacked orientation. A plurality of blind holes bored in the plurality of wooden layers, the plurality of blind holes in one or more of the plurality of wooden layers positioned to correspond to the plurality of blind holes in one or more of the plurality of wooden layers and a plurality of biodegradable fasteners for insertion into the plurality of blind holes.

In accordance with an aspect of the invention, there is provided a method of assembly of an access mat system. A method of assembling an access mat system, comprising stacking a plurality of wooden layers on to each other. Boring a plurality of blind holes into the wooden layers such that the plurality of blind holes in one or more of the plurality of wooden layers correspond to the plurality of blind holes in one or more of the plurality of wooden layers and inserting a plurality of biodegradable fasteners into the blind holes.

In accordance with an embodiment of the invention, the plurality of biodegradable fasteners are wooden dowels.

In accordance with an embodiment of the invention, one or more surfaces of the wooden layers contains a non-toxic glue.

In accordance with an embodiment of the invention, one or more surfaces of the biodegradable fasteners contains a non-toxic glue.

In accordance with an embodiment of the invention, one or more surfaces of the blind holes contains a non-toxic glue.

In accordance with an embodiment of the invention, the biodegradable fasteners are threaded.

In accordance with an embodiment of the invention, the biodegradable fasteners contain one or more wedges.

In accordance with an embodiment of the invention, the biodegradable fasteners contain one or more glue grooves.

In accordance with an embodiment of the invention, the one or more glue grooves contains a non-toxic glue.

In accordance with an embodiment of the invention, the blind holes contain a glue reservoir.

In accordance with an embodiment of the invention, the blind holes are vertical in orientation.

In accordance with an embodiment of the invention, the blind holes are oriented at an angle to the vertical.

In accordance with an embodiment of the invention, the blind holes have a vertical oriented blind hole and an angled blind hole to the vertical superimposed.

In accordance with an embodiment of the invention, the access mat is assembled upside down.

In accordance with an embodiment of the invention, a non-toxic glue is applied to one or more surfaces of the wooden layers.

In accordance with an embodiment of the invention, a non-toxic glue is applied to one or more surfaces of the biodegradable fasteners.

In accordance with an embodiment of the invention, a non-toxic glue is applied to one or more surfaces of the blind holes.

In accordance with an embodiment of the invention, a non-toxic glue is applied to one or more glue grooves.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

The details of one or more embodiments of the subject matter of this specification are set forth in the accompanying drawings and the description below. Other features, aspects, and advantages of the subject matter will become apparent from the description, the drawings, and the claims.

Like reference numbers and designations in the various drawings indicate like elements.

Access mats are built and employed on construction sites such as, but not limited to, roadways, lease sites or private property such that the work completed on these sites doesn't tear up the ground and landscape and there is as little environmental impact as possible. Access mats may be employed on any terrain such as, but not limited, to grass, swamps, mud, ice, snow and sand. An access mat system and method of assembly, presented hereafter, is composed of environmentally friendly materials which are compostable, pelletized or turned into shaving for heating, animal bedding, mulch etc., recyclable or repurposed into value added products, while remaining cost effective and highly durable. This is achieved through the use of biodegradable fasteners to ensure that disposal is environmentally friendly as possible. Additionally, the use of non-toxic glue, such as but not limited to food grade glue, may be employed for environmentally friendly disposal or recycling the access mats after their life expectancy has been reach.

The access mat system provides a temporary roadway onto a construction site while ensuring minimal disturbance and destruction to the surrounding environment, as well as environmentally friendly disposal once the access mats can no longer serve their function.

Figure 1:
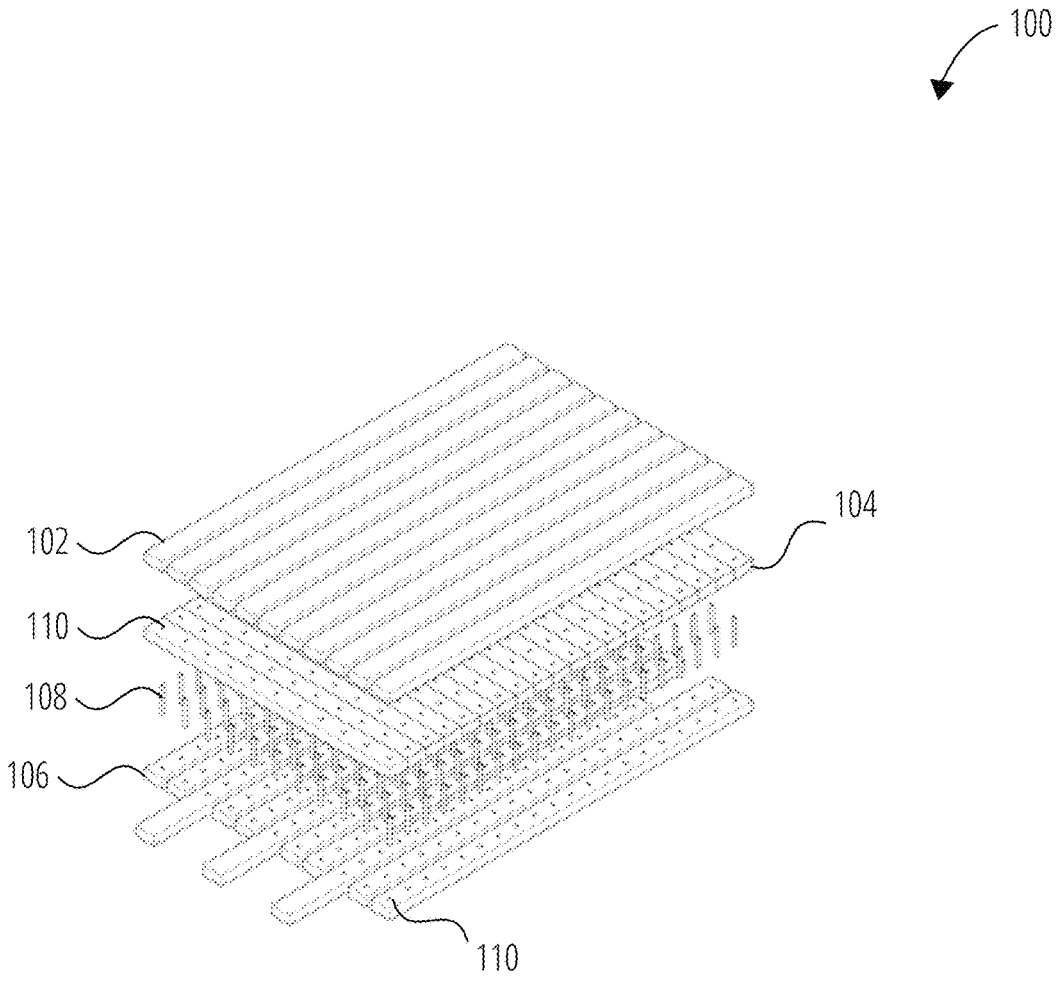
FIG. 1 illustrates an aspect of the subject matter in accordance with one embodiment.

FIG. 1 depicts an exploded upright view 100 of the access mat system as in one embodiment. In this embodiment, the plurality of layers is represented by three distinct layers, a top member 102, an intermediate member 104 and a bottom member 106. This embodiment also displays the wooden layers stacked in a crisscross formation, the wooden layers may be stack in other formations common in the art.

The access mat system comprises a plurality of wooden layers arranged in a stacked orientation and a plurality of blind holes 110 bored in the wooden layers. The plurality of blind holes 110 in the plurality of wooden layers are positioned to correspond to the plurality of blind holes 110 in one or more of the plurality of wooden layers. A plurality of blind holes 110 are shown on the intermediate member 104 and the bottom member 106. A plurality of biodegradable fasteners, shown as wooden dowels 108 in FIG. 1, are for insertion into the blind holes 110.

In some embodiments, the biodegradable fasteners are non-metallic and biodegradable. This embodiment displays each wooden layer as a composition of multiple boards affixed along the same plane. In other embodiments, one or more wooden layers may be composed of a single board. In some embodiments, the access mats are designed to be lightweight to ensure undemanding transportation as the access mats need to be transported from job site to job site.

Figure 2:
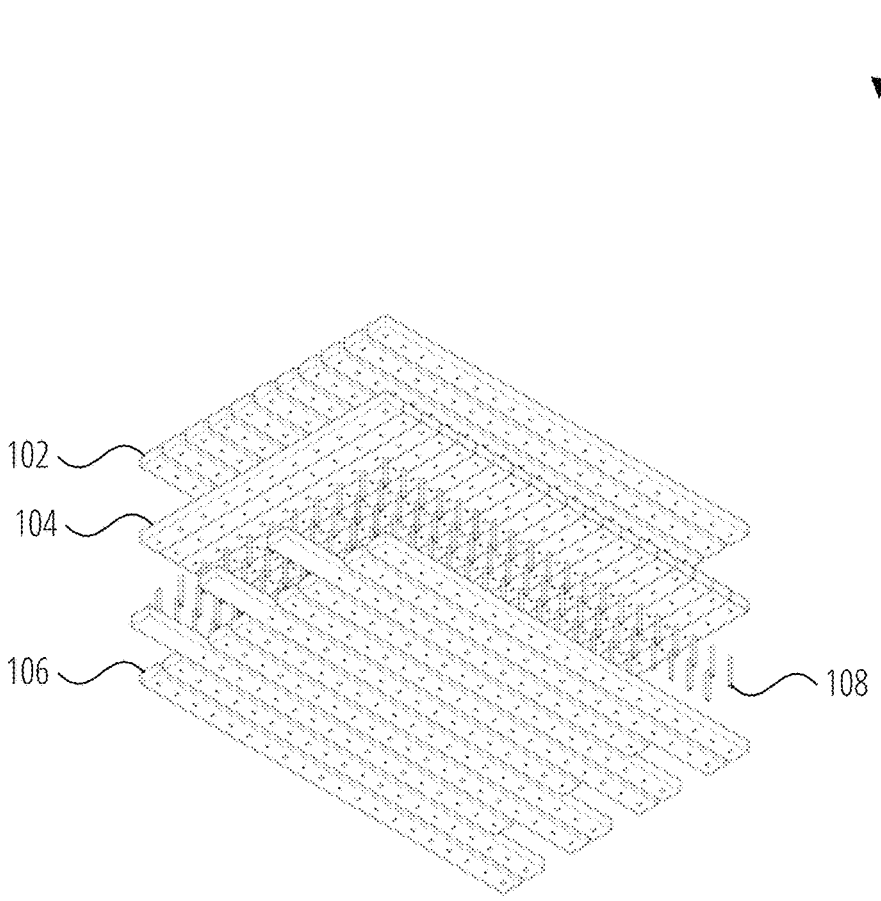
FIG. 2 illustrates an aspect of the subject matter in accordance with one embodiment.

FIG. 2 depicts an exploded inverted view 200 of the access mat system as in one embodiment. This embodiment displays a plurality of blind holes 110 in the top member 102, not shown in FIG. 1. The combination of FIG. 1 and FIG. 2 displays a top member 102 with a plurality of blind holes 110 which do not penetrate through the top member 102, while the plurality of blind holes 110 in the intermediate member 104 and the bottom member 106 are shown to penetrate through the intermediate member 104 and the bottom member 106. In some embodiments, the access mats are assembled upside down for ease of assembly, as well as to help the top surface of the top member 102 in pristine condition.

Figure 3:
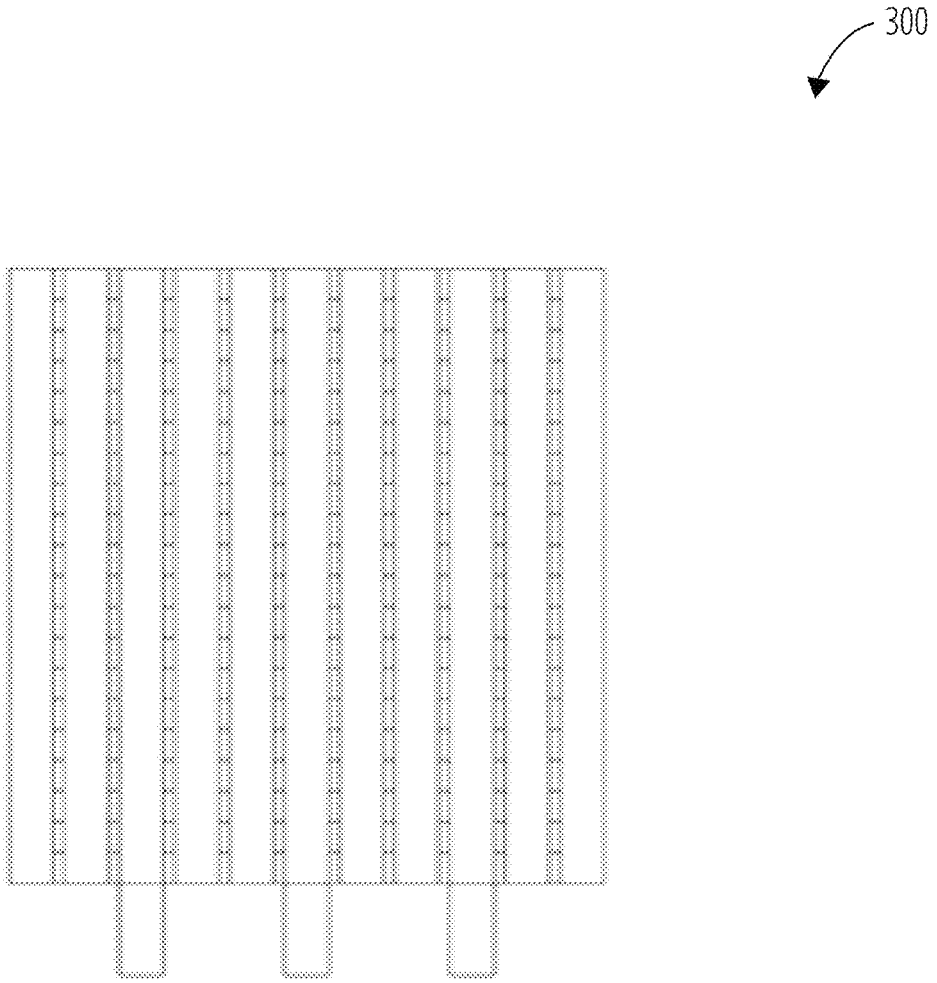
FIG. 3 illustrates an aspect of the subject matter in accordance with one embodiment.

FIG. 3 depicts a top view of assembled mat 300 of the access mat system as in one embodiment.

Figure 4:
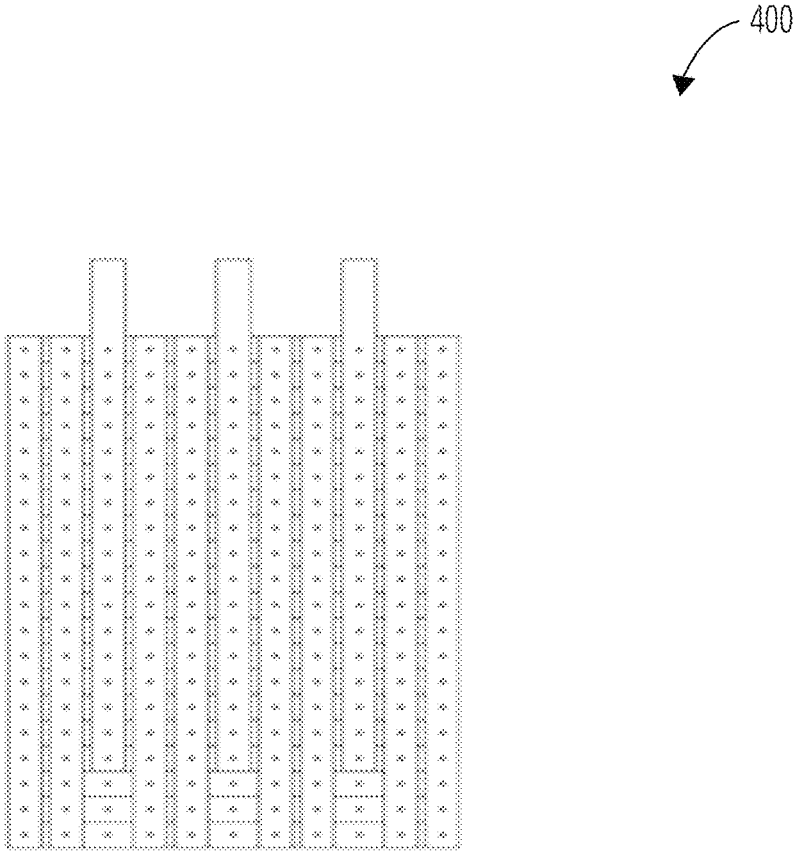
FIG. 4 illustrates an aspect of the subject matter in accordance with one embodiment.

FIG. 4 depicts a bottom view of assembled mat 400 of the access mat system as in one embodiment.

A method of assembling the access mat system comprises stacking a plurality of wooden layers on to each other, boring a plurality of blind holes 110 into the wooden layers such that plurality of blind holes 110 in one or more of the plurality of wooden layers correspond to the plurality of blind holes 110 in one or more of the plurality of wooden layers and inserting a plurality of biodegradable fasteners into the blind holes 110.

Figures 5A, 5B, 5C:
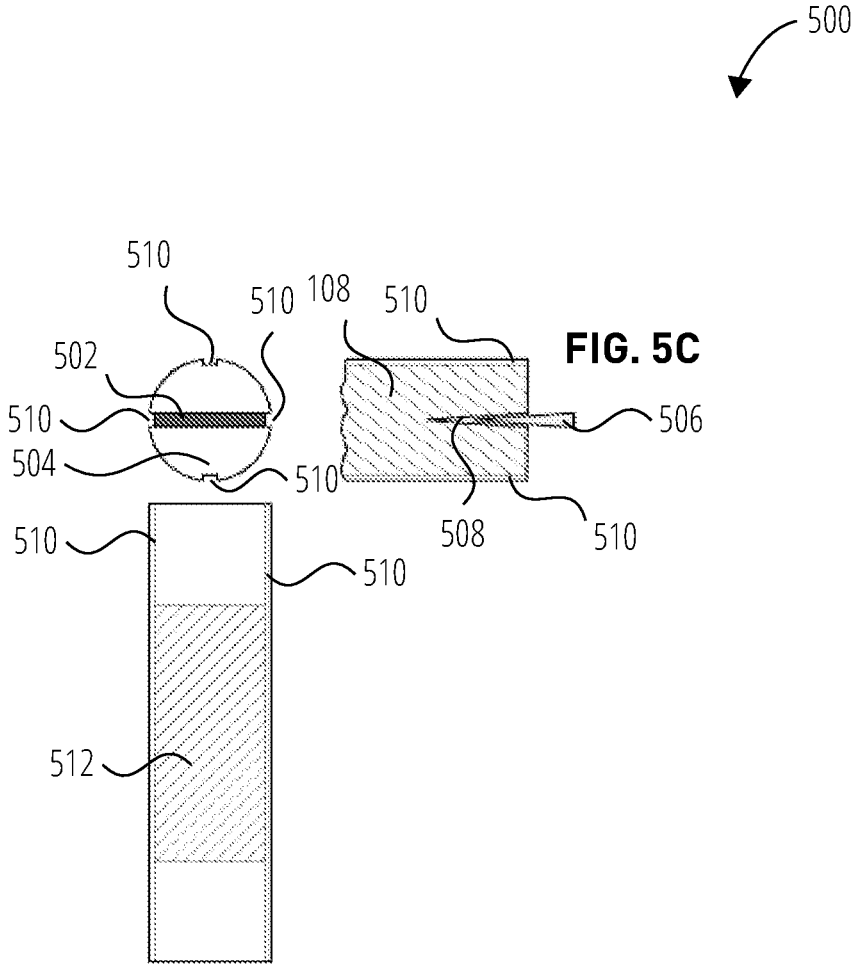
FIG. 5A, FIG. 5B and FIG. 5C illustrate aspects of the subject matter in accordance with one embodiment.

FIG. 5A depicts a wedge dowel 500 of the access mat system as in one embodiment. FIG. 5B depicts a straight slot 502 displayed in the dowel head 504, which is utilized to accept a wedge 506. In some embodiments, the straight slots 502 are cut along the grain of the wooden dowel 108 to promote the splitting desired when inserting and driving the wedge 506 into the wooden dowel 108. FIG. 5C depicts a wedge 506 shown driven into a wooden dowel 108 after the wooden dowel 108 is driven into the bottom of a blind hole 110. In some embodiments, the wooden dowels 108 may contain a wedge 506 on each end of the wooden dowel 108. In some embodiments, the wooden dowels 108 contain three-quarter inch deep straight slots 502. In some embodiments, a non-toxic glue 508 may be applied to the slot from the dowel head 504 prior to insertion of the wedge 506. In some embodiments, the non-toxic glue is a food grade glue or any other non-toxic glues in the art.

Typically, the wooden dowels 108 have a minimum of four glues glue grooves 510, as shown in FIG. 5, where the non-toxic glue 508 can be inserted during assembly. In other embodiments, the wooden dowels 108 may contain a dowel head 504 with one or more of the glue grooves 510. The glue grooves 510 in this embodiment span the entire dowel body 512. In other embodiments, one or more glue grooves 510 may span a fraction of the dowel body 512. In some embodiments, the glue grooves 510 are longitudinal by an eighth of an inch deep.

Figure 6:
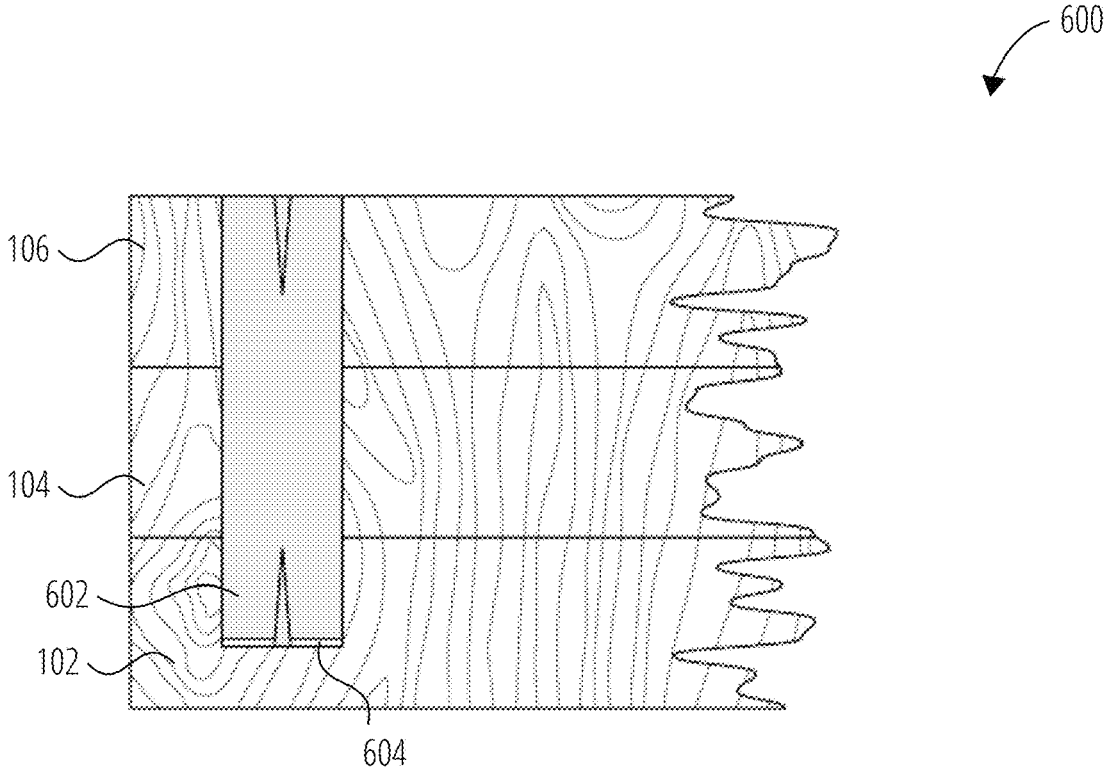
FIG. 6 illustrates an aspect of the subject matter in accordance with one embodiment.

FIG. 6 depicts a wedge dowel method 600 of the access mat system as in one embodiment. In this embodiment, three wooden layers comprise a completed access mat, a bottom member 106, an intermediate member 104 and a top member 102. During assembly, the top member 102 may be placed such that it is present against the ground, follow by stacking the intermediate member 104 onto the top member 102 and the bottom member 106 onto the intermediate member 104. In some embodiments, a non-toxic glue 508 is applied to one or more surfaces of the wooden layers. In some embodiments, a non-toxic glue 508 is applied to one or more surfaces of the wooden dowels 108. In some embodiments, a non-toxic glue 508 is applied to one or more surfaces of the wedges 506. In some embodiments, a non-toxic glue 508 is applied to one or more surfaces of the blind holes 110.

A vertical blind hole 602 is drilled through the bottom member 106, the intermediate member 104 and the top member 102 such that a vertical blind hole 602 results within the top member 102. A glue reservoir 604 is present at the bottom of the vertical blind hole 602 to add further adhesion of the wedge dowel 500 across wooden layers of the access mat.

As the wooden dowel 108 and the wedge 506 are forced into the vertical blind hole 602, non-toxic glue 508 within the glue reservoir 604 is forced upwards to further assist in the adhesion of the wooden dowel 108 across the wooden layers of the access mat. In some embodiments, the wooden dowel 108 is covered in non-toxic glue 508 prior to insertion into the vertical blind hole 602. In some embodiments, the wedge 506 is covered in non-toxic glue 508 prior to insertion into the wooden dowel 108. Once assembly is complete, the access mat may be rotated vertically such that the bottom members 106 is present against the ground. In some embodiments, the dowel body 512 is an eighth of an inch shorter than the vertical blind hole 602.

Figure 7:
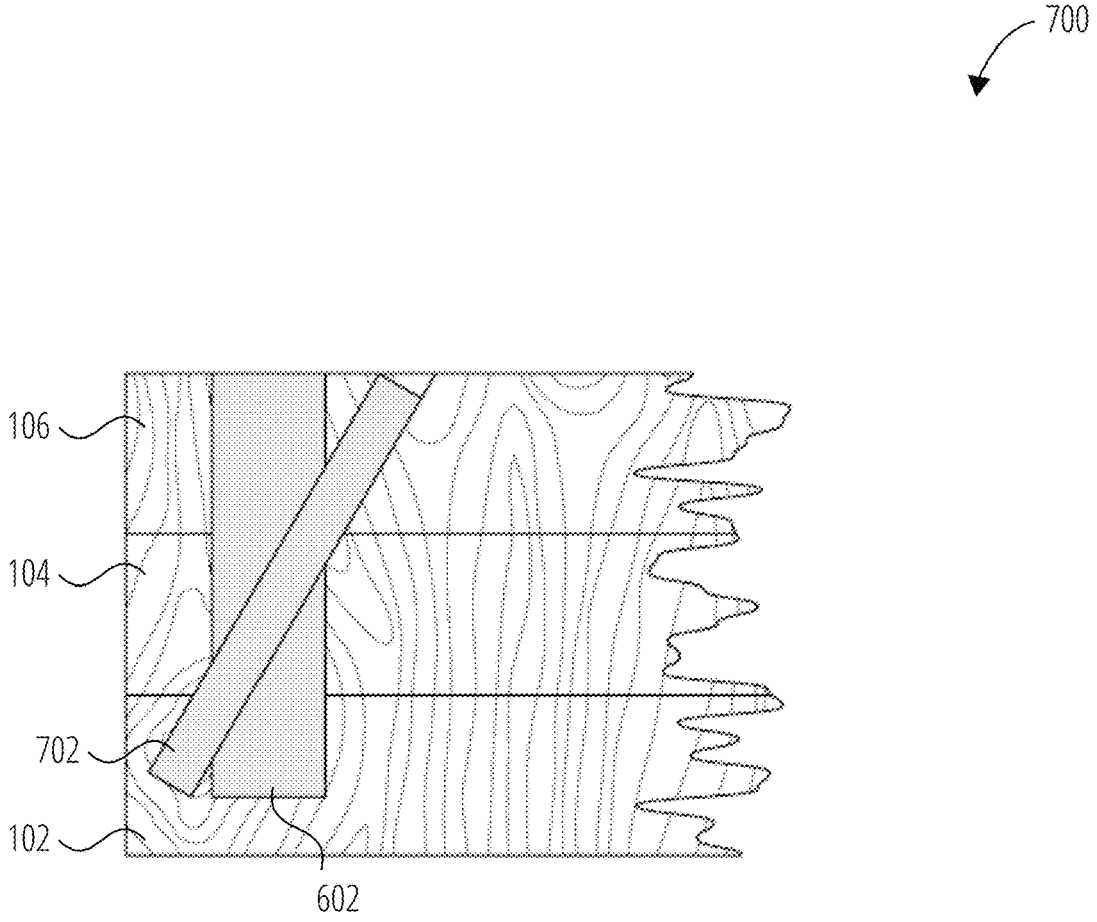
FIG. 7 illustrates an aspect of the subject matter in accordance with one embodiment.

FIG. 7 depicts a cross dowel method 700 of the access mat system as in one embodiment. A vertical blind hole 602 and a cross blind hole 702 are shown superimposed across the wooden layers of the access mat. The cross blind hole 702 is shown traversing the bottom member 106, the intermediate member 104 and the top member 102 at an angle from the vertical blind hole 602. The wooden dowels 108 are inserted during assembly to ensure contact and connection between all wooden layers of the access mat. In some embodiments, the cross blind hole 702 contains a glue reservoir 604.

In some embodiments, the angle of the cross blind hole 702 for the wooden dowel 108 is based on the length of the wooden dowel 108 to ensure that the wooden dowel 108 is coupled to all of the wooden layers that form the access mat. In some embodiments, the wooden dowel 108 is inserted into the cross blind hole 702 after a wooden dowel 108 has been inserted into the vertical blind hole 602. The insertion of a wooden dowel 108 into to a vertical blind hole 602 and a cross blind hole 702 further restricts movement of the wooden layers and reduces the shear force between the wooden layers of the access mats.

Figure 8:
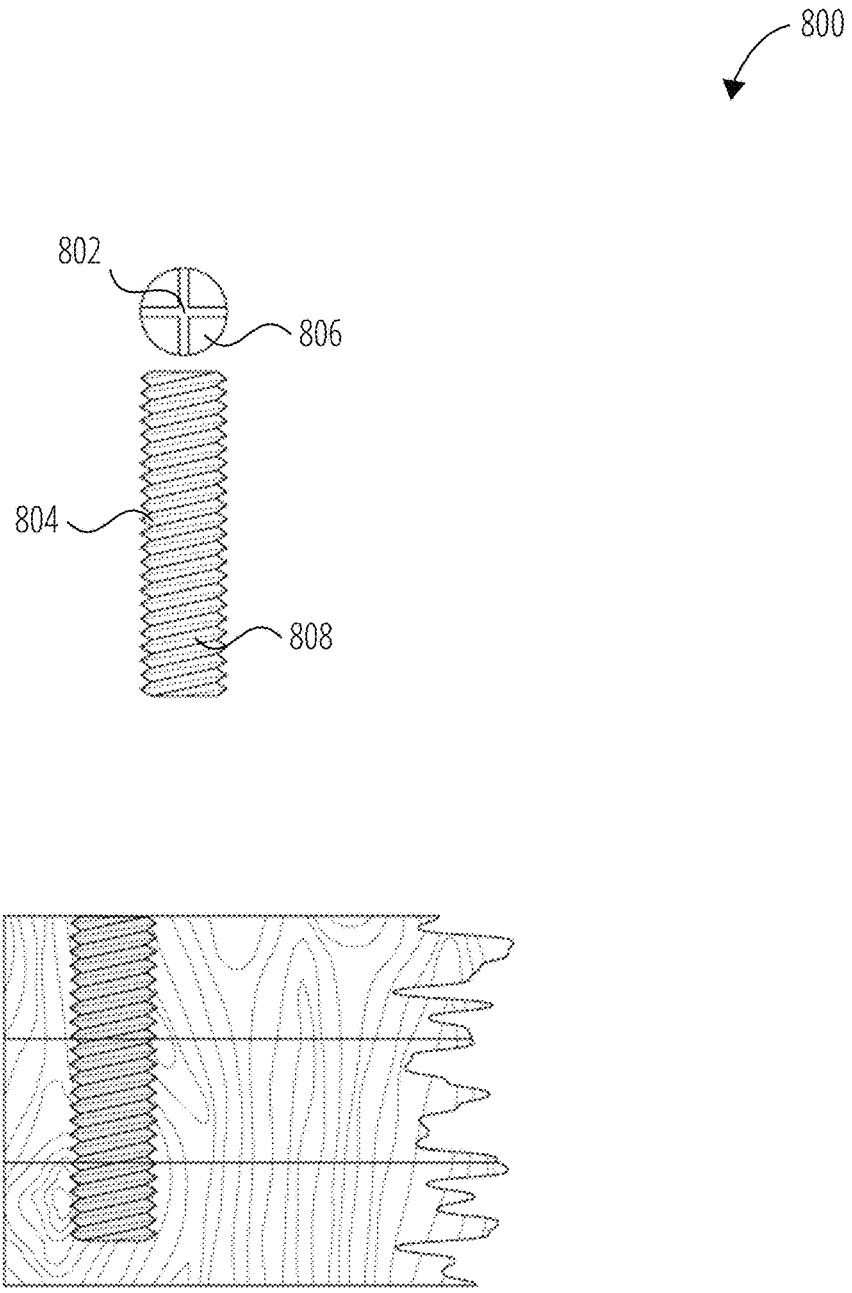
FIG. 8 illustrates an aspect of the subject matter in accordance with one embodiment.

FIG. 8 depicts a threaded dowel 800 of the access mat system as in one embodiment. A cross slot 802 configuration is shown on the dowel head 806 which may be coupled to a Phillips screwdriver to provide the required torque during assembly. In other embodiments, the dowel head 806 can be configured for a Robertson, hexlobe, square, tri-wig, hex socket, torq-set, triple square, polydrive, double hex, bristol, pentalobular, one way, spline, security hex, security hexlobe, spanner or any other configuration known in the art. The dowel body 808 in FIG. 8 contains a threaded exterior 804. In some embodiments, the wooden dowels 108 are hammered into the blind holes 110.

In one embodiment, the threaded exterior 804 contains six threads per inch, the dowel body 808 has a width of one and one quarter inches and a length of four and three quarter inches, and the cross slot 802 has a length of one eighth of an inch and a depth of a quarter of an inch. In some embodiments, a minimum of one hundred and seventy seven wooden dowels 108 are used during assembly to secure three wooden layers of a completed access mat. In some embodiments, one or more of the elements from the access mat system can be manufactured from materials such as, but not limited to, straight grain maple, birch, poplar, hemlock, Douglas-fir, bamboo, and oak.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient but is intended to cover the application or implementation without departing from the spirit or scope of the claims of the present invention.

What is claimed is:

1. An access mat system, comprising:

a plurality of wooden layers, said layers arranged in a stacked orientation;

a plurality of vertical blind holes bored in a topmost layer of said plurality of wooden layers and a plurality of vertical through holes bored in remaining layers of said plurality of wooden layers, said plurality of vertical blind holes in said topmost layer of said plurality of wooden layers positioned to correspond to said plurality of vertical through holes in one or more of the remaining layers of said plurality of wooden layers;

a plurality of first biodegradable fasteners for insertion into said plurality of vertical blind holes and said vertical through holes;

a plurality of angled through holes bored through one or more of said plurality of first biodegradable fasteners at an angle to the vertical blind holes and vertical through holes; and a plurality of second biodegradable fasteners for insertion into said plurality of said angled through holes.

2. The access mat system of claim 1, wherein said plurality of first and second biodegradable fasteners are wooden dowels.

3. The access mat system of claim 1, wherein one or more surfaces of said wooden layers contains a non-toxic glue.

4. The access mat system of claim 1, wherein one or more surfaces of said first and second biodegradable fasteners contains a non-toxic glue.

5. The access mat system of claim 1, wherein one or more surfaces of said vertical blind holes, said vertical through holes and said angled through holes contains a non-toxic glue.

6. The access mat system of claim 1, wherein said first and second biodegradable fasteners are threaded.

7. The access mat system of claim 1, wherein said first and second biodegradable fasteners contain one or more wedges.

8. The access mat system of claim 1, wherein said first and second biodegradable fasteners contain one or more glue grooves.

9. The access mat system of claim 8, wherein said one or more glue grooves contains a non-toxic glue.

10. The access mat system of claim 1, wherein said vertical blind holes each contain a glue reservoir.

11. A method of assembling an access mat system, comprising:

stacking a plurality of wooden layers on to each other;

boring a plurality of vertical blind holes into a topmost layer of said wooden layers and boring a plurality of vertical through holes into remaining layers of said plurality of wooden layers such that said plurality of vertical blind holes in said topmost layer of said plurality of wooden layers correspond to said plurality of vertical through holes in one or more of the remaining layers of said plurality of wooden layers;

inserting a plurality of first biodegradable fasteners into said vertical blind holes and said vertical through holes boring a plurality of angled through holes bored through one or more of said plurality of first biodegradable fasteners at an angle to the vertical blind holes and vertical through holes; and inserting a plurality of second biodegradable fasteners into said angled through holes.

12. The method of assembling said access mat system from claim 11, wherein said access mat is assembled upside down.

13. The method of assembling said access mat system from claim 11, wherein a non-toxic glue is applied to one or more surfaces of said wooden layers.

14. The method of assembling said access mat system from claim 11, wherein a non-toxic glue is applied to one or more surfaces of said first and second biodegradable fasteners.

15. The method of assembling said access mat system from claim 11, wherein a non-toxic glue is applied to one or more surfaces of said vertical blind holes, said vertical through holes and said angled through holes.

16. The method of assembling said access mat system from claim 11, wherein said first and second biodegradable fasteners contain one or more glue grooves.

17. The method of assembling said access mat system from claim 11, wherein a non-toxic glue is applied to one or more glue grooves.

* * * * *